United States Patent [19]

Engel

[11] Patent Number: 4,850,061

[45] Date of Patent: Jul. 25, 1989

[54] FOLDED TOILET SEAT COVER

[76] Inventor: Avner Engel, 3009 Medway St., Silver Spring, Md. 20902

[21] Appl. No.: 168,938

[22] Filed: Mar. 16, 1988

[30] Foreign Application Priority Data

May 10, 1987 [IL] Israel ..... 82469

[51] Int. Cl.[4] ..... A47K 13/16

[52] U.S. Cl. ..... 4/243

[58] Field of Search ..... 4/242, 243, 244, 245, 4/246

[56] References Cited

U.S. PATENT DOCUMENTS

| | | | |
|---|---|---|---|
| 1,155,260 | 9/1915 | Meyer | 4/243 |
| 1,268,024 | 3/1918 | Levin | 4/243 |
| 1,358,222 | 11/1920 | Levy | 4/242 |
| 1,999,676 | 4/1935 | Wilkniss | 4/243 |
| 2,280,092 | 4/1942 | Kirch et al. | 4/243 |
| 3,588,921 | 6/1971 | Nagel | 4/243 |

FOREIGN PATENT DOCUMENTS

| | | | |
|---|---|---|---|
| 1174002 | 9/1984 | Canada | 4/243 |
| 503660 | 12/1954 | Italy | 4/243 |
| 88/01844 | 3/1988 | PCT Int'l Appl. | 4/243 |

*Primary Examiner*—Henry J. Recla
*Assistant Examiner*—Robert M. Fetsuga

[57] ABSTRACT

The present invention relates to an individually packaged disposable toilet seat cover folded to pocket size dimensions. The cover comprises a main sheet of a lightweight material having two detachable application stubs extending from opposite ends of the main sheet. When the stubs are pulled away from each other in one continuous motion, the cover unfolds from its stowed position into its full-sized deployed position.

According to a preferred embodiment of the invention, two or more sticking mechanisms are placed radially on the toilet seat cover. Two such mechanisms are associated with the application stubs. The sticking mechanism consists of an adhesive surface and a protective strap covering the adhesive surface. Thus, after placing the cover on the seat, the application stubs are detached from the main sheet, and in the same motion the protective straps are removed and the adhesive surfaces are exposed to enable the cover to adhere to the seat.

Preferably, the folded seat cover of the invention is packaged in individual pocket size containers for convenient handling. As an example, the size of such a container can be 8×6×0.2 cm and 10 such folded and packaged toilet seat covers can fit into a box having the size of 8×6×2 cm.

6 Claims, 6 Drawing Sheets

FOLDED TOILET SEAT COVER

The present invention relates to disposable hygienic articles, in particular, toilet seat covers which are folded and packaged into pocket-sized containers for convenient handling and easy deployment.

In Western society water closets, or toilets as they are generally called, are formed with a bowl defining an eliptic rim in the horizontal plane: A seat is usually associated with the toilet and is supported on the rim permitting a user to sit above the bowl.

Public places, such as bus stations, airports, restaurants and movie-houses, provide facilities used by extremely large numbers of people. Semi-public facilities in office buildings and other places of work are used by a relatively smaller number of people. It is not practicable nor is it practiced to clean the toilet seat between uses. Consequently, these facilities, on the whole, are not clean and not esthetic.

For such types of toilet facilities it is desired to provide a layer of protective material between the user and the toilet seat or the toilet bowl. Such layer of protective material should be easily replaced for each user.

Disposable toilet seat covers are known. They usually define an eliptical ring which has an outer dimension of the toilet seat and an inner dimension which permits uninterrupted bowel movement and urination. Known disposable toilet seat covers of the above mentioned types suffer from the considerable disadvantage that they are inconvenient to carry, awkward to place on the toilet and tend to slide off the toilet seat or become crumpled when the user moves.

In order to overcome some of the above mentioned disadvantages, more advanced disposable toilet seat covers were developed. It is known to use toilet seat covers provided with a sticking mechanism in the form of small adhesive patches mounted on the bottom surface of the seat cover. Such patches are covered with matching pieces of wax paper which serve as a protective cover for the adhesive patches. The major disadvantage of such known toile seat covers is that the user must turn them upside down in order to pull off all the protective covers to reveal the adhesive patches. This process is inconvenient and tedious. The toilet seat cover tends to lose its integrity and stick to itself. Another drawback of such known toilet seat covers is that the user must touch the bottom surface of the toilet seat cover. Since the toilet seat cover must first be laid upon the toilet seat, the user risks soiling his hands in the process.

It is the object of the present invention to provide a toilet seat cover which is easy to carry, easy to deploy and is devoid of the above mentioned disadvantages which are common in known toilet seat covers.

Thus, in accordance with the present invention there is provided an individually packaged disposable toilet seat cover consisting of a main sheet of lightweight material, whose shape adapts to cover a toilet seat when said cover is in the deployed position, and folds to pocket size dimensions when said cover is in the stowed position characterized in that said cover further consists of two detachable application stubs extending from two opposite ends of the main sheet. Said stubs, when pulled away from each other in one continuous motion, cause said cover to unfold from its stowed position to its full-sized deployed position.

The toilet seat cover of the invention is opened from its stowed position into its full-size deployed position by an easy and simple action which consists of pulling the application stubs away from each other. Subsequently the toilet seat cover is placed on the toilet seat with the application stubs extending from the contour of the seat.

When sticking means are provided with the toilet seat cover, two such means are associated with the application stubs. The sticking means consist of an adhesive surface and a protective strap covering the adhesive surface. Thus, after placing the cover on the seat, the application stubs are detached from the main sheet, and in the same motion the protective straps are removed and the adhesive surfaces are exposed enabling the cover to adhere to the seat.

The toilet seat cover of the invention can be made of any light weight sheet such as paper, plastic material, or a combination thereof.

In accordance with one embodiment of the invention the toilet seat cover of the invention is made of water-dissoluble paper such as silk paper.

In accordance with another embodiment of the invention, the toilet seat cover is made of thin paper sheet impregnated with plastic material or coated with a thin layer of plastic foil.

The dimensions of the main sheet of the toilet seat cover of the invention are such that the outer dimensions are sufficient to extend over the surface of a toilet seat when fully unfolded and spread horizontally over the toilet bowl. The inner dimensions insure total coverage of the toilet seat inner portion and yet permit room for uninterrupted bowel movements and urination. The toilet seat cover may also be provided with its inner portion, outlined by perforations or other detachable means and thus easily removable before use.

Preferably, the folded toilet seat cover of the invention is packaged into individual pocket size containers for convenient handling. As an example, the size of such container can be $8\times6\times0.2$ cm and 10 such folded and packaged toilet seat covers can fit into a box having the size of $8\times6\times2$ cm.

The size of the individual package can vary as required and it is determined by the type of material the sheet is made of, the method of folding and the number of folds. Preferably, the dimensions of an individual package is in the range of 6 to 10 cm by 4 to 8 cm by 0.1 to 0.5 cm.

The invention is illustrated by way of example only, with reference to the accompanying drawings in which.

Figure 1:
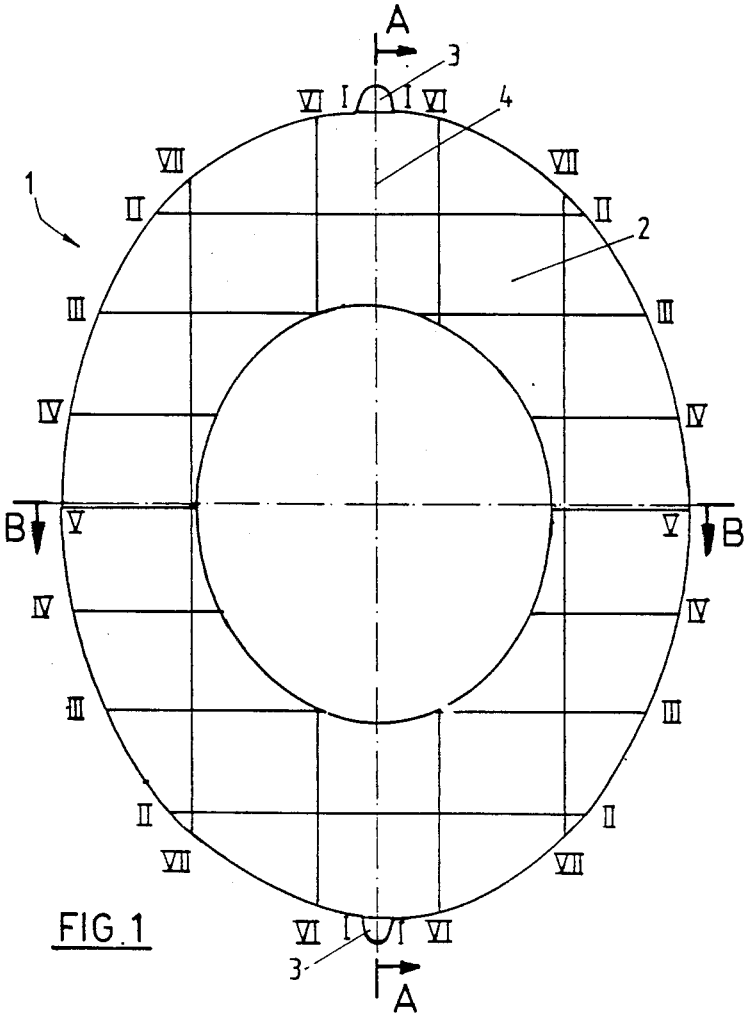
FIG. 1 is a top view illustration of a toilet seat cover of the invention in the unfolded position with folding edges shown.

FIG. 1 shows the toilet seat cover 1 in the shape of an oval ring made of a main sheet of lightweight paper 2 and having two application stubs 3 extending from opposite ends of main sheet 2. Toilet seat cover 1 shown in FIG. 1 is in the unfolded position ready for deployment on a toilet seat. The location of the folding edges at the folded position are also marked in the figures. Thus lines I—I, II—II, III—III, IV—IV and V—V represent the horizontal folding edges normal to the main axis 4 connecting the application stubs, and lines VI—VI and VII—VII represent the vertical folding edges parallel to axis 4. The folding edges marked by Roman numerals are designed in a pleated way so that a pull of application stubs 3 away from each other causes the entire toilet seat cover to unfold to its full-sized deployed position. In order to achieve that end, the direction of the foldings must be alternated in a right-left-right-left fashion. If folding edge I—I is defined as a left folding then folding edge II—II must be a right folding, folding III—III a left folding, and so forth. In order to ensure that the application stubs appear along the same edge while the main sheet is in its folded position, it is required that the number of horizontal folding edges will be odd.

Figure 2:
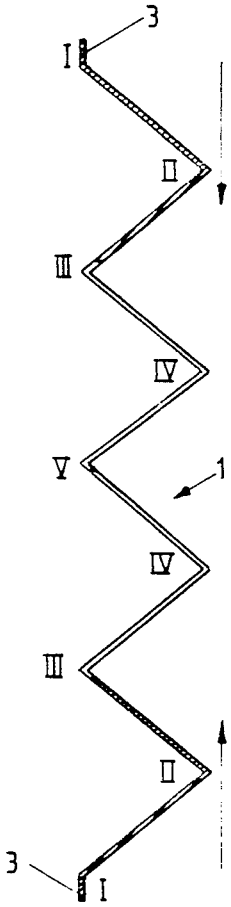
FIG. 2 is a cross sectional view of the toilet seat cover shown in FIG. 1 along line A—A in its semi-folded position.
Figure 3:
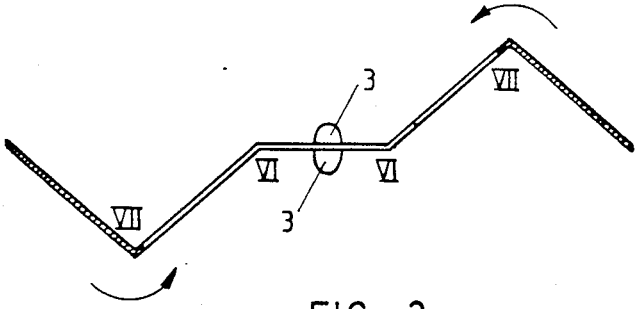
FIG. 3 is a cross sectional view of the toilet seat cover shown in FIG. 1 along line B—B, in its semi-folded position.

The cross-sectional views of the semi-folded positions of the toilet seat cover shown in FIGS. 2 and 3, with their distinct folding edges marked by the Roman numerals I to VII, are depicted for illustrative purposes opposite the corresponding folding edges in FIG. 1. The arrows shown in FIGS. 2 and 3 represent the direction of folding the flat sheet of paper to the stowed position as performed by the manufacturer. The horizontal foldings shown in FIG. 2 are performed first and subsequently the vertical foldings shown in FIG. 3 are performed.

Figure 4:
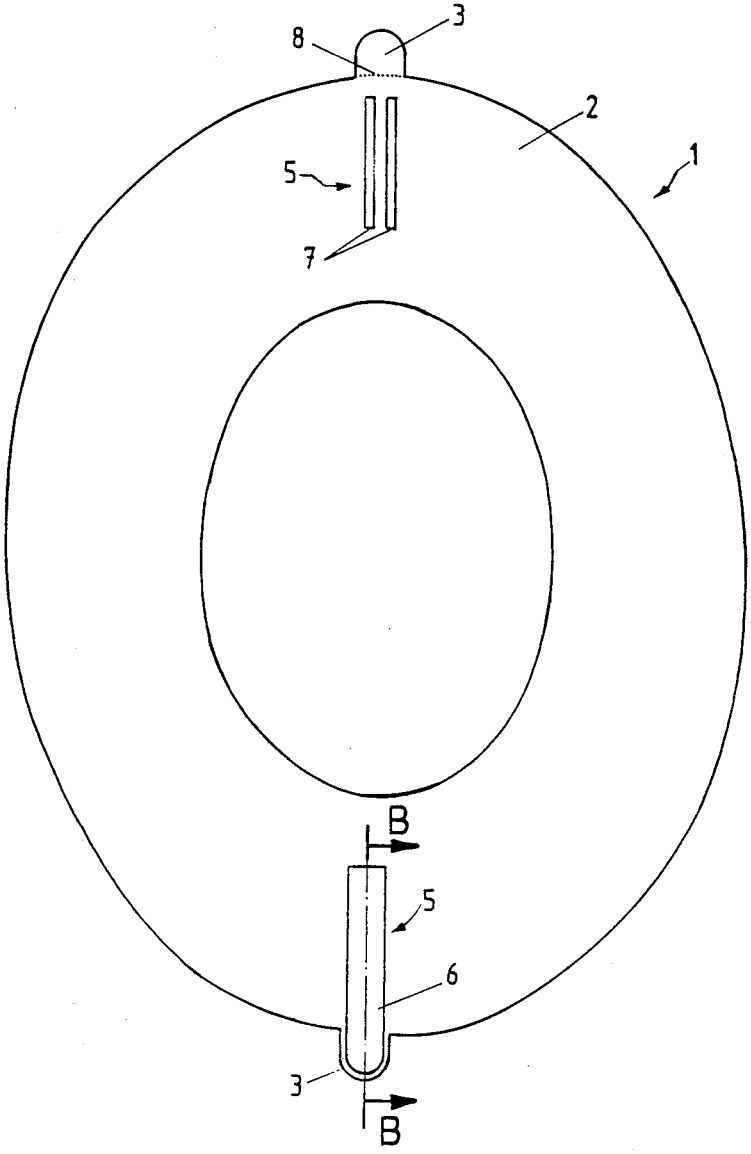
FIG. 4 is a bottom view of the toilet seat cover shown in FIG. 1 (folding edges not shown).

The bottom view of toilet seat cover 1 depicted in FIG. 4 shows the sticking mechanism 5 consisting of two units. One unit of sticking mechanism 5 is shown with the protective strap 6 covering adhesive strips 7 are exposed. Perforated edge 8 is also shown in FIG. 4. Application stubs 3 are in effect a continuation of main sheet 2 and are easily detachable therefrom by removing stubs 3 along perforated edge 8.

Figure 5:
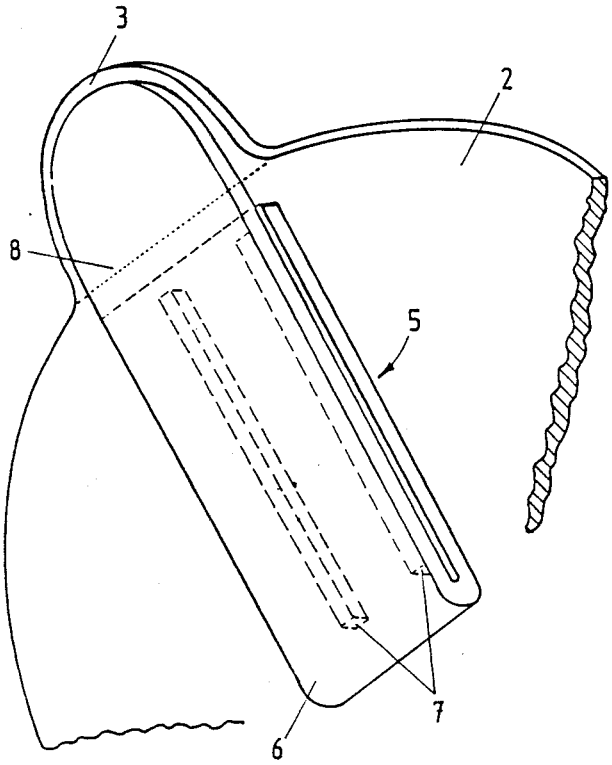
FIG. 5 is a perspective view of a single sticking mechanism illustrated in FIG. 4.
Figure 6:
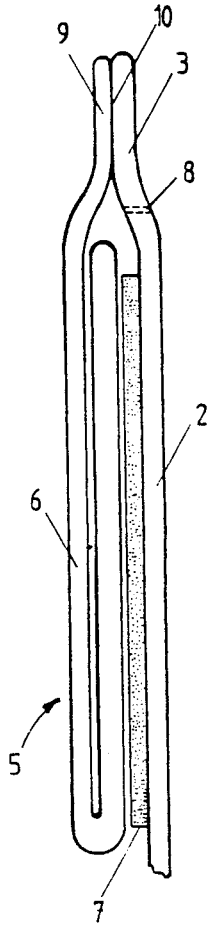
FIG. 6 is a cross sectional view of the sticking mechanism shown in FIG. 4 along the B—B line.

The sticking mechanism is illustrated in more detail in FIGS. 5 and 6. FIG. 5 shows a perspective view of the application stub 3, the sticking mechanism 5 and its relationship to the main sheet 2. The application stub 3 is simply a continuation of the main sheet 2 through a perforated edge 8.

The sticking mechanism is composed of the following elements: Non-drying adhesive strips 7 applied to the main sheet 2. Any number of non-drying adhesive strips may be applied; however, the adhesive strips must be covered and protected by a removable strap. Removable protective strap 6 made of thin waxed paper is folded into a U shape and placed over the adhesive strips in such a way that the non-drying adhesive strips are fully covered and thus, any sticking onto other parts of the toilet seat cover is avoided.

FIG. 6 shows a cross-sectional view of the application stub 3, and the sticking mechanism 5 and their relationships to main sheet 2. The perforated edge 8 defines the contact area between application stub 3 and main sheet 2. The non-drying adhesive strip 7 is applied directly onto main sheet 2. The removable strap 6 is laid directly on the non-drying adhesive strips. This removable strap is set into a U-shape. As depicted in the figure, the right hand leg of the U rests on the adhesive strip whereas the upper portion 9 of the left leg of the U is permanently attached by a glue layer 10 to application stub 3.

The exposure of adhesive strips 7 is performed after the toilet seat cover has been fully extended to its full size and placed on the toilet seat. Application stub 3 is torn from main sheet 2 and extracted outward and away from the main sheet 2. Simultaneously, a portion 9 of the left leg of the U is pulled away. As the left hand leg of the U is pulled, the right hand leg of the U becomes shorter and shorter until the entire removable strap 6 is pulled away and the non-drying adhesive strips are exposed to the toilet seat.

Figure 7:
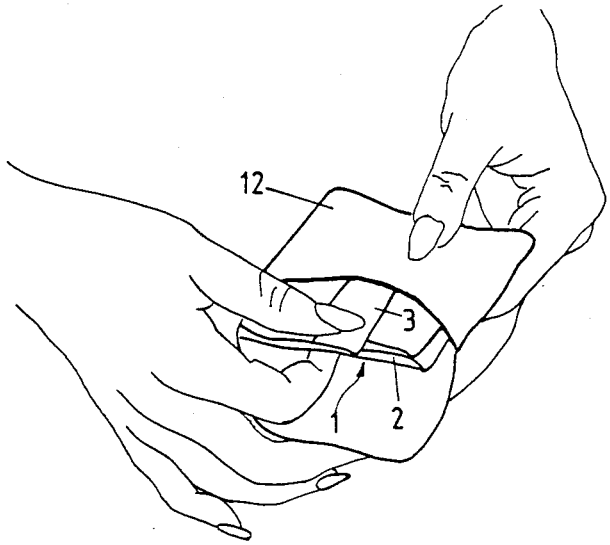
FIGS. 7 to 11 are schematic illustrations of the method of Deployment of the toilet seat cover shown in FIGS. 1 to 4.

The method of using the toilet seat cover 1 is illustrated in FIGS. 7 to 11. FIG. 7 illustrates the extraction of the toilet seat cover 1 in its stowed position from its container 12. The container 12 is made of thin plastic material in the shape of an envelope. Other materials which can be hermetically sealed to insure the sterility of the toilet seat cover, to protect it from absorbing moisture and prevent deodorant or fragrance, if added, from escaping are also suitable. The application stubs 3 are folded back over the main sheet as depicted in the figure.

Figure 8:
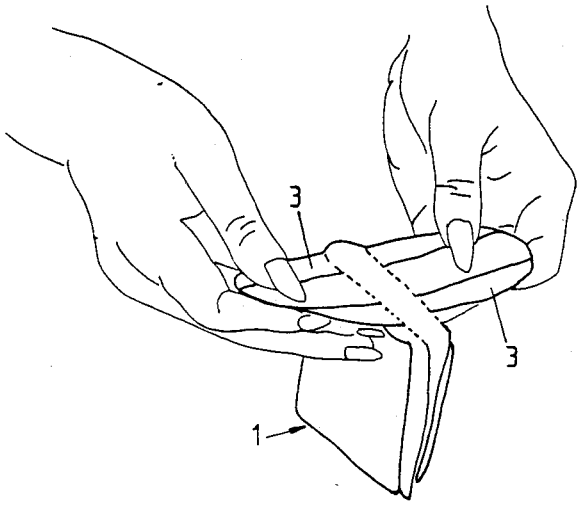

FIG. 8 illustrates the grasping of the folded toilet seat cover 1 in preparation for deployment. The application stubs 3 are held between the forefinger and the thumb as shown in the illustration.

Figure 9:
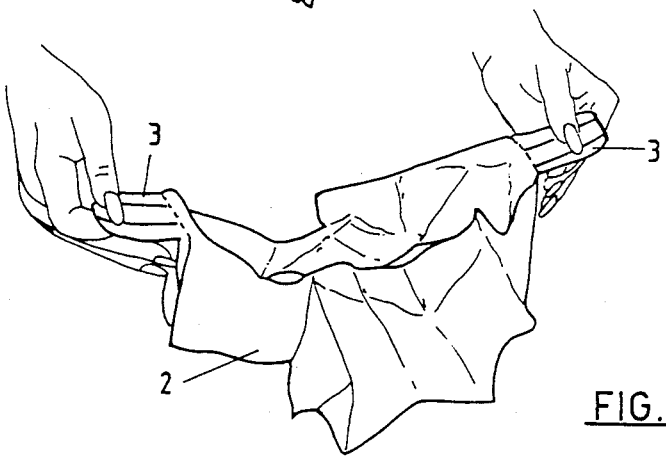

FIG. 9 illustrates pulling the application stubs 3 outward and away from one another whereby the main sheet 2 is expanded into its semi-folded position. This action is the first stage of a double-phased deployment activity. The arrangement of the folding edges on the main sheet, the relative size of the application stubs and the strength of the paper material from which the main sheet is made ensure smooth and complete opening of the toilet seat cover from its stowed position into its full-sized deployed position.

Figure 10:
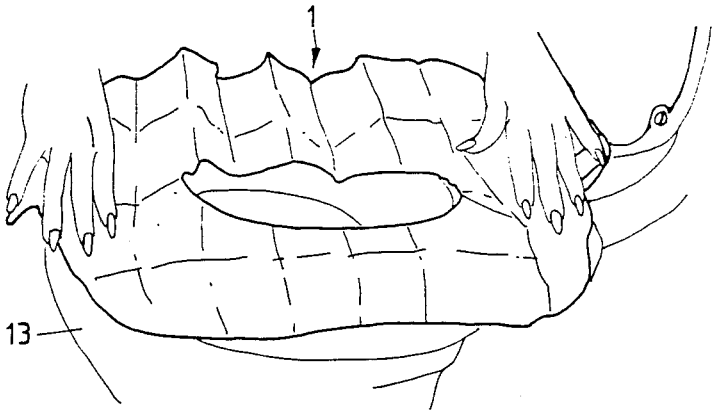

FIG. 10 illustrates the placing of the toilet seat cover 1 in its fully extended and deployed position over a toilet set 13 or a toilet bowl. The bottom surface of the main sheet fits snugly over the toilet seat 13.

Figure 11:
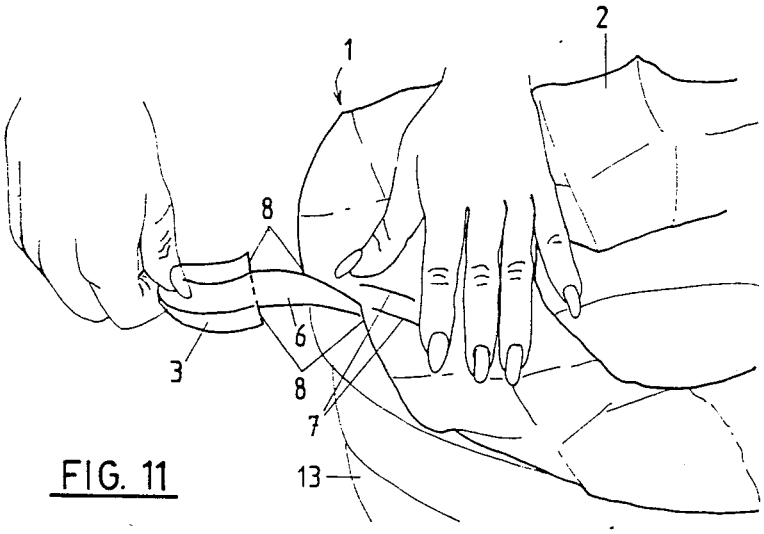

FIG. 11 illustrates the process of bonding the toilet seat cover 1 onto the toilet seat 13. The application stub 3 is detached from the main sheet 2 along the perforated edge 8. The removable strap 6 is pulled away exposing the adhesive strips 7 to the toilet seat 13. A slight downward pressure on the main sheet at the area of the adhesive strips will ensure a firm bond between the toilet seat cover and the toilet seat. This action is the second stage of the double-phased deployment activity. This process will be repeated with the second application stub and its sticking mechanism. If more than two sticking mechanisms are placed radially on the main sheet, the above process will be performed for each one of the sticking mechanisms.

FIGS. 12 to 15 illustrate another embodiment of the invention differing from the embodiment described above in the method of folding the cover at the manufacturing stage and in the shape of the stowed product. Otherwise, all the components of the product are the same and so is the method of application.

Figure 12:
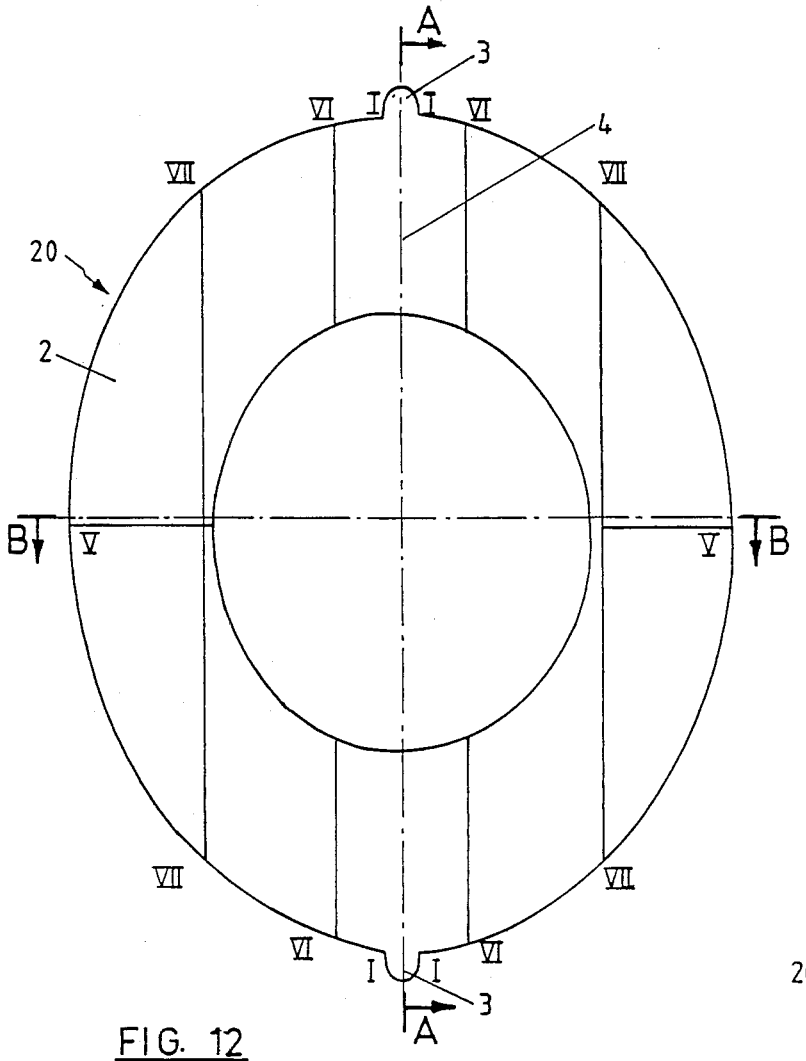
FIG. 12 is a top view illustration of a toilet seat cover according to another embodiment of the invention.
Figure 14:
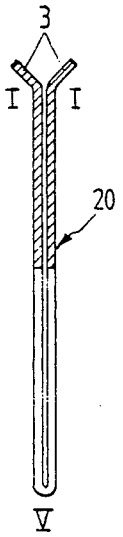
FIG. 14 is a cross sectional view of the toilet seat cover shown in FIG. 12 in its semi folded position along line A—A.
Figure 15:
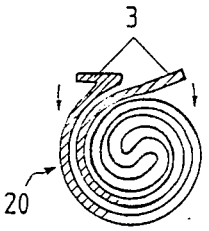
FIG. 15 is a cross sectional view of the toilet seat cover shown in FIG. 12 in its rolled, stowed position along line A—A.
Figure 13:
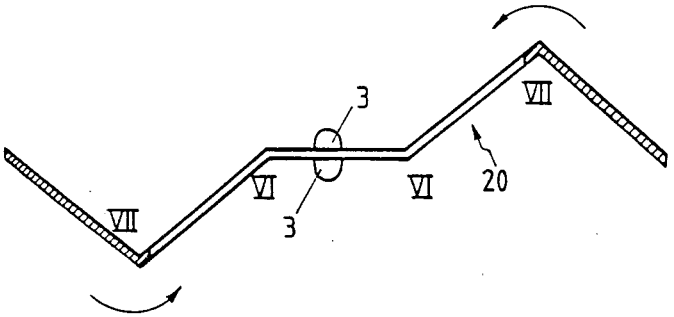
FIG. 13 is a cross-sectional view of the toilet seat cover shown in FIG. 12 in its semi-folded position along line B—B.

The toilet seat cover 20 shown in FIGS. 12 to 15 has main sheet 2 application stubs 3 and sticking mechanism not shown in the figures. FIG. 12 shows the main sheet 2, application stubs 3 and axis 4. Lines I—I and V—V represent the folding edges normal to the main axis and lines VI—VI and VII—VII represent folding edges parallel to the axis 4. FIG. 13 shows a cross-sectional view of the main sheet in its semi-folded position along the cross section B—B of FIG. 12. FIG. 13 represents a first folding phase of a three phase stowing process. FIG. 14 shows a cutaway cross-sectional view of the main sheet 2 in its semi-folded position along the cross-section A—A of FIG. 12. This represents a second folding phase of the three phase stowing process. The folding edge V is designed to bring the two application stubs 1 to the same edge while the main sheet 2 is in the stowed position. The foldings at edge I are designed to separate the two application stubs 1 from each other. FIG. 15 shows the cross-sectional view of the main sheet 2 in its stowed position along the cross-section A—A of FIG. 12. This represents a last rolling phase of the three phase stowing process. The application stubs 3 are folded in two different directions. This provides convenient user access in order to grasp and pull the application stubs for deployment of the toilet seat cover.

In all embodiments of the invention, the process of sticking the toilet seat cover to the toilet seat or toilet bowl is done without having to touch the bottom of the toilet seat cover and without resorting to turning the toilet seat cover upside down. This approach ensures that the user does not have to touch the bottom surface of the toilet seat cover which has been placed on the toilet seat and may be soiled. This approach also ensures the integrity of the toilet seat cover since turning it upside down may cause it to tangle, lose its shape or slip into the toilet bowl.

After use, the toilet seat cover 1 can easily be removed from the toilet seat by grasping the main sheet 2 and peeling it away from the seat. The seat cover 1 is then disposed of by flushing it in the toilet bowl or by placing it in a waste basket.

The toilet seat cover lends itself to automated production. The production line is composed of several paper handling machines organized along an integrated production line which is composed of the following sections:

1. A feed station which provides a continuous flow of silk paper for the main sheet from a large paper roll.
2. An impregnation and fragrance station where the bottom of the main sheet is impregnated with an ultra-thin layer of plastic film to make the main sheet water resistant. In addition, a specific fragrance may be added to the main sheet.
3. A perforating station where perforation of the edges between the main sheet and the application stubs is carried out.
4. A sticking mechanism station where the areas of the non-drying adhesive surfaces are covered with non-drying glue and the areas of the application stubs are covered with regular glue. A feed mechanism provides wax paper straps which are folded appropriately and placed on the glue to form the complete sticking mechanism.
5. A cutting station where the main sheet is cut into its final size. The inner edge may only be perforated if the toilet seat cover is to be provided with its inner portion.
6. A folding station where the pleated foldings are performed. The horizontal foldings are performed first and the vertical foldings are performed afterwards. This station may also perform rolling of the main sheet if this type of stowing is desired.
7. A unit wrapping station where the individual toilet seat covers in their stowed position are placed in a plastic unit container.
8. A retail box packing station where an appropriate number of toilet seat covers are packed into retail boxes.

I claim:

1. An individually packaged disposable toilet seat cover comprising a main sheet of lightweight material, having a shape adapted to cover a toilet seat when said cover is in a deployed position, and folded to pocket size dimensions when said cover is in a stowed position characterized in that said cover further comprises two detachable application stubs extending from two opposite ends of the main sheet, said cover in the stowed position is folded into parallel accordion type folds, normal to the main axis connecting the application stubs and further folded to parallel accordion type folds parallel to the main axis, said stubs when pulled away from each other in one continuous motion unfold said cover from the stowed position into the full sized deployed position.

2. A toilet seat cover according to claim 1 further comprising two or more sticking mechanisms connected to the cover for attaching said cover to the toilet seat, each of said sticking mechanism consists of an adhesive surface and a protective strap covering said adhesive surface, wherein two of the protective straps covering the adhesive surfaces are attached to the application stubs in such a way that upon detachment of the application stubs from the main paper sheet protective straps are removed and the adhesive surfaces are exposed.

3. A toilet seat cover according to claim 1 wherein the lightweight material is water-impermeable paper or paper coated with water impermeable material.

4. A toilet seat cover according to claim 1 wherein the lightweight material is silk paper.

5. A toilet seat cover according to claim 1 packed in a lightweight protective container.

6. A toilet seat cover according to claim 1 wherein said cover in the stowed position has the following dimension range: 6 to 10 cm by 4 to 8 cm by 0.1 to 0.5 cm.

* * * * *